United States Patent [19]

Craig et al.

[11] Patent Number: 4,609,376

[45] Date of Patent: Sep. 2, 1986

[54] ANTI-WEAR ADDITIVES IN ALKANOL FUELS

[75] Inventors: Raymond C. Craig, Wantage, England; Jerome Panzer, Millburn, N.J.; Max J. Wisotsky, Highland Park, N.J.; Morton Beltzer, Westfield, N.J.

[73] Assignee: Exxon Research and Engineering Co., Florham Park, N.J.

[21] Appl. No.: 717,551

[22] Filed: Mar. 29, 1985

[51] Int. Cl.[4] ..... C10L 1/18

[52] U.S. Cl. ..... 44/53; 44/70; 44/77

[58] Field of Search ..... 44/53, 70, 77

[56] References Cited

U.S. PATENT DOCUMENTS

| | | | |
|---|---|---|---|
| 2,527,889 | 10/1950 | Moore et al. | 44/70 |
| 2,548,347 | 4/1951 | Caron et al. | 44/70 |
| 2,891,089 | 6/1959 | Jolly | 44/70 |
| 4,032,303 | 6/1977 | Dorer, Jr. et al. | 44/70 |
| 4,177,768 | 12/1979 | Davis | 123/1 |
| 4,185,594 | 1/1980 | Perilstein | 123/1 |
| 4,198,931 | 4/1980 | Malec | 123/1 |
| 4,204,481 | 5/1980 | Malec | 123/1 |
| 4,208,190 | 6/1980 | Malec | 44/53 |
| 4,242,099 | 12/1980 | Malec | 44/53 |
| 4,248,182 | 2/1981 | Malec | 123/1 |
| 4,375,360 | 3/1983 | Washecheck et al. | 44/53 |
| 4,448,586 | 5/1984 | Weidig | 44/70 |

*Primary Examiner*—Mrs. Y. Harris-Smith

*Attorney, Agent, or Firm*—Edward H. Mazer

[57] ABSTRACT

An additive for alkanol-containing fuels is disclosed which has improved lubricating and wear characteristics. The additive comprises an ester of a monocarboxylic or polycarboxylic acid and a polyhydric alcohol.

25 Claims, No Drawings

ANTI-WEAR ADDITIVES IN ALKANOL FUELS

BACKGROUND OF THE INVENTION

This invention relates to the use of selected additives in alkanol fuels to reduce or inhibit wear.

The use of alcohols and particularly methanol as an engine fuel has been known for some time. However, the use of methanol and other such alkanol fuels, particularly when used neat, has been found to produce excessive wear. Much of the wear which is caused by a fuel of this type, such as methanol, has been found to take place on the piston rings and upper cylinder areas of an engine. This wear results from "washing away" the lubricant film and direct chemical attack of the fuel and its corrosive combustion products on the metal surfaces of the cylinder liner. Fuel blowby into the lubricant, i.e. the fuel and its combustion products blow past the rings, and the resulting reaction with lubricant additives also can lead to a general increase in engine wear with alkanol fuels.

Changes in lubricant formulations have been one approach to solving the aforesaid wear problem associated with alkanol fuels. Other attempts have included the use of additives in methanol fuel to help lubricity, while reducing the wear characteristics. Additives used have included fatty alcohols, alcohol ethoxylates, fatty acids and ethoxylates, ester including mono-, di, polyol and phosphate esters and polyalkylene glycols as disclosed in U.S. Pat. No. 4,375,360. Other additives have included a number of organo acids as shown in U.S. Pat. Nos. 4,177,768; 4,185,594; 4,242,099; and 4,248,182. Further additives noted as useful in alkanol fuels have included n-hydroxy hydrocarbonamide disclosed in U.S. Pat. No. 4,198,931; fatty acid amides or esters of diethanolamine disclosed in U.S. Pat. No. 4,204,481; and straight chain aliphatic primary amines disclosed in U.S. Pat. No. 4,208,190.

While a number of different approaches have been disclosed, as described above, to provide reduced wear in alkanol fueled engines, there is further need for a fuel system which will provide reduced engine wear and improved lubricity while retaining compatibility.

SUMMARY OF THE INVENTION

It has now been found that alkanol fuels containing a selected additive which is an ester of a carboxylic acid and a polyhydric alcohol and having at least two free hydroxyl groups, have improved wear and lubricity characteristics.

More particularly, this invention is directed to a fuel composition comprising a major amount of a monohydroxy alkanol having from 1 to 5 carbon atoms and an effective wear reducing amount of an additive which is an ester of a monocarboxylic or polycarboxylic acid and a polyhydric alcohol, said acid having up to about 4 carboxylic acid groups and about 12 to 90 carbon atoms, said alcohol having about 2 to 10 hydroxyl groups and about 2 to 30 carbon atoms and said ester having at least two free hydroxyl groups. The composition has improved lubricity properties and provides improved wear reduction.

DETAILED DESCRIPTION OF THE INVENTION

This invention is directed to alkanol fuel compositions containing a selected additive which is an ester of a carboxylic acid and a polyhydric alcohol and having at least two free hydroxyl groups, said composition having improved wear and lubricity characteristics.

The selected ester additive used in this invention is generally derived from the esterification of a monocarboxylic or polycarboxylic acid and a polyhydric alcohol with said ester having at least two free hydroxyl groups. More particularly, the ester additive used in this invention is a hydroxy-containing ester of a monocarboxylic or polycarboxylic acid and a polyhydric alcohol, said acid having up to about 4 carboxylic acid groups and about 8 to about 90 carbon atoms, said alcohol having about 2 to 10 hydroxyl groups and about 2 to 30 carbon atoms.

The acid used in preparing the ester is an aliphatic, saturated or unsaturated, straight chained or branched mono- or polycarboxylic acid having up to about 4 carboxylic acid groups and about 8 to about 90 carbon atoms. When such acid is a monocarboxylic acid, it generally will contain about 8 to about 30, preferably about 10 to about 28 and more preferably about 12 to about 22 carbon atoms.

When the acid used in preparing the ester additive of this invention is a polycarboxylic acid, it generally will be an aliphatic saturated or unsaturated, preferably saturated polycarboxylic acid having about 2 to about 4, preferably about 2 to about 3 and more preferably about 2 carboxylic acid groups. This acid will contain about 12 to about 90, preferably about 24 to about 90 and more preferably about 24 to about 65 carbon atoms with at least about 9 up to about 42, preferably about 12 to about 42 and more preferably about 16 to about 22 carbon atoms between the carboxylic acid groups.

The alcohol used in preparing the ester additive of this invention is generally an aliphatic, saturated or unsaturated, straight chained or branched polyhydric alcohol having about 2 to about 10, preferably about 2 to about 6 and more preferably about 2 to about 4 hydroxyl groups, and about 2 to about 90, preferably about 2 to 30, more preferably about 2 to about 12, and most preferably about 2 to about 5 carbon atoms in the molecule. The alcohol selected is preferably saturated.

Further description and illustrations of the above-described acids and alcohols may be found in Kirk-Othmer "Encyclopedia of Chemical Technology", Second Edition, Volume 1, 1963, pp. 224–254 and 531–598.

Whatever combination of acid and alcohol, as described above, is used in preparing the ester addition of this invention, the final compound must have at least two free hydroxyl groups and preferably is hydroxyl terminated.

Generally, in preparing the ester additives used in the invention, the proportions of alcohol and acid can be varied but are selected so as to minimize the amount of free acid remaining in the final product. In many cases a molar excess of alcohol to acid will be used. The amounts, however, are dependent on the particular acid and alcohol used in preparing the ester additive.

The preferred ester additive used in this invention is one derived from the esterification of a polycarboxylic acid with a glycol or glycerol, preferably a glycol. Such an ester may typically be a di- or polyester having the following general formulas when using a glycol:

$$\text{HO—R—OOC—R''—COOR'—OH} \quad (1)$$

$$\text{HO—R—OOC—R''—COOR—OOC—R'''—COOR'—OH} \quad (2)$$

wherein R'' is the hydrocarbon radical of said acid and each R and R' may be the same or different hydrocarbon radicals associated with a glycol or diol as defined herein. It will, of course, be appreciated that esters of the type illustrated by the foregoing formulas can be obtained by esterifying a polycarboxylic acid, or a mixture of such acids, with a diol or mixture of such diols.

The oil insoluble glycol which is reacted with the polycarboxylic acid may be an alkane diol, i.e., alkylene glycol or an oxa-alkane diol, i.e., polyalkylene glycol, straight chain or branched. The alkane diol may have from about 2 to about 12 carbon atoms and preferably about 2 to about 5 carbon atoms in the molecule and the oxa-alkane diol will, generally, have from about 4 to about 200, preferably about 4 to about 100 carbon atoms. The oxa-alkane diol (polyalkylene glycol) will, of course, contain periodically repeating groups of the formula:

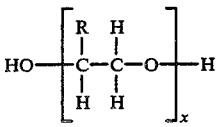

wherein R may be H, $CH_3$, $C_2H_5$ or $C_3H_7$, and x is 2 to 100, preferably 2 to 25. The preferred alkane diol is alkylene glycol is ethylene glycol and the preferred oxa-alkane diol or polyalkylene glycol is diethylene glycol. As indicated previously, glycerol may also be used in preparing the ester of polycarboxylic acid and it is contemplated that such component will also include its higher molecular weight analogues.

The ester also may be prepared by the reaction of an alcohol, preferably a polyhydric alcohol, with an ester and/or polyester which also may have some free acid present. A preferred ester for reaction is lanolin and a preferred alcohol is sorbitol. The alcohol reacts with acid present in the ester and/or via transesterification to form the desired ester compound having free hydroxyl groups.

While any of the esters as set forth above can be effectively used, best results are, however, obtained with such compounds wherein the carboxyl groups of the polycarboxylic acid are separated from each other by from about 16 to about 22 carbon atoms and wherein the hydroxyl groups are separated from the closest carboxyl group by from about 2 to about 12 carbon atoms. Particularly desirable results have been obtained with additives prepared by esterifying a dimer of a fatty acid particularly those containing conjugated unsaturation with a polyhydroxy compound. While the patentability of the present invention is not predicated on the mechanism by which dimers useful in the present invention are produced, one proposed series of reactions by which dimer acids are produced from linoleic acid, oleic acid and mixtures of these acids is illustrated by the following:

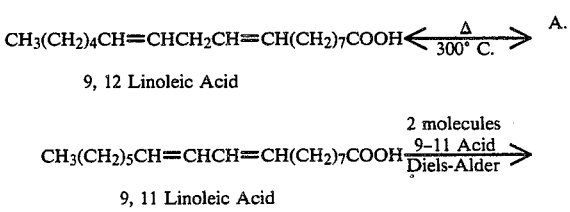

-continued

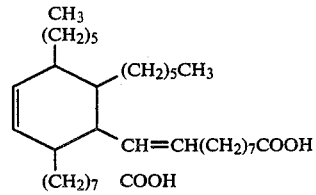

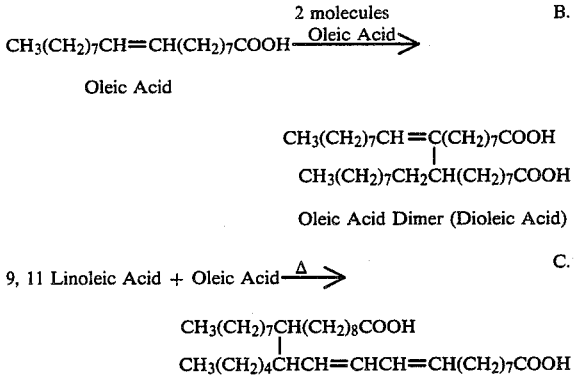

The commercial preparation of these fatty acid dimers will, generally, lead to trimer formation and in some cases the product thus obtained will contain minor amounts of unreacted monomer or monomers. As a result, commercially available dimer acids may contain as much as 25% trimer and the use of such mixtures is within the scope of the present invention.

The particularly preferred hydroxy-substituted ester additives useful in the present invention will be the reaction product of a dimerized fatty acid, such as those illustrated, a glycol, and preferably an oil insoluble glycol, which may be produced by various techniques. Preferred acid dimers are the dimers of linoleic acid, oleic acid or the mixed dimer of linoleic and oleic acids, which may also contain some monomer as well as trimer. Other specifically satisfactory glycols in addition to ethylene glycol and polyethylene glycol are, for example, propylene glycol, polypropylene glycol, butylene glycol, polybutylene glycol and the like.

It is to be understood that when the ester additive of this invention is obtained from a monocarboxylic acid, the polyhydric alcohol will contain at least three hydroxyl groups in order to provide the necessary hydroxyl functionality on the final product. Where the ester of a fatty monocarboxylic acid is being prepared, a preferred alcohol is glycerol. The resulting ester preferably is ethoxylated. A preferred fatty acid is coconut acid.

The fuel compositions of this invention primarily comprise alkanols, i.e., the alkanols comprise at least 50% by weight, preferably a major part, and more preferably at least 80% by weight of the composition. The useful alkanols are monohydroxy alcohols containing from 1 to about 5 carbon atoms with saturated aliphatic monohydric alcohols being preferred. Illustrative alcohols of this type are methanol, ethanol, propanol, n-butanol, isobutanol, amyl alcohol and isoamyl alcohol, with methanol being preferred.

The hydroxyl containing ester additive of this invention will generally be used at an effective wear reducing amount and more particularly at a concentration of from about 0.0003 to about 2.0 percent by weight, preferably from about 0.001 to about 1.0 and more preferably from about 0.002 to about 0.5 percent by weight, based on the total weight of the fuel composition.

Other additives, which are known in the art and which do not adversely affect the selected additives of this invention, may be used in the fuel composition. Such additives may include demulsifying agents, dyes, antioxidants, corrosion inhibitors, ignition accelerators, etc.

The following examples are further illustrative of this invention and are not intended to be construed as limitations thereof.

EXAMPLE 1

A fuel composition was prepared and comprised methanol and 38 ppm of an ester formed by esterification of a dimer acid of linoleic acid and diethylene glycol and having the formula:

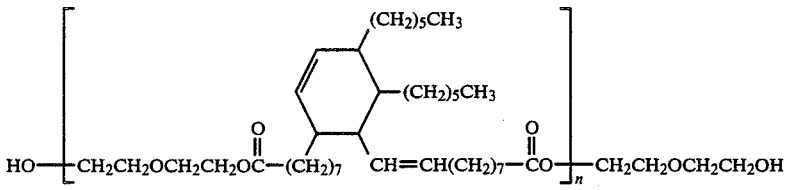

where n=1 to 5

The use of this fuel composition was tested to determine the effect on wear using a slant 6 Dodge engine operating under conditions in which wear is accelerated. The engine was operated for 10 minutes at 700 rpm, no load, followed by 20 minutes at 2000 rpm and a load of 105 lb. ft. This cycle was repeated for 72 hours with the oil sump temperature maintained at 50° C. Used oil samples were removed at 24 hour intervals and analyzed for wear metals by plasma emissions spectroscopy.

The amount of wear metal in the used oil after 72 hours was 72.7 ppm Fe and 13.8 ppm Cu. This compared with 103.3 ppm Fe and 26.8 ppm Cu (average of 2 runs) when the same methanol fuel without the ester additive was used.

EXAMPLE 2

A fuel composition was prepared comprising methanol and 38 ppm of polyoxyethylene sorbitol lanolin. This composition was tested as in Example 1 and showed metal wear of 39.6 ppm Fe and 20.9 ppm Cu.

EXAMPLE 3

Another series of tests were run on a slant 6 Dodge engine in cyclic operation as in Example 2. A specially formulated oil, designated as Oil A, was used in several of these tests. A conventional, commercial lubricant containing an ester formed by esterification of a dimer acid of linoleic acid and diethylene glycol designated as Oil B, was used in other tests. A third oil, designated as Oil C, similar to Oil B, but without the ester additive, also was tested. The results are presented in Table I below. As before, the Fe concentration in the used oil is a measure of engine wear.

TABLE I

ENGINE WEAR WITH VARIOUS FUELS AND LUBRICANTS

| LUBRICANT | FUEL | Fe IN USED OIL, PPM 96 HOUR TEST |
|---|---|---|
| Oil A | Unleaded Premium Gasoline | 34 |
| Oil A | Methanol | 50 |
| Oil A | Methanol | 52 |
| Oil A | Methanol + 90 ppm Ester(1) | 30 |
| Oil B | Methanol | 105 |
| Oil C | Methanol | 84 |

(1)Ester of dimer acid of linoleic acid and diethylene glycol.

From Table I it can be seen that the combination of the specially formulated lubricant and methanol having the ester additive resulted in significantly lower engine wear than methanol without the ester additive in combination with the same lubricant. The combination of the specially formulated oil and methanol with the ester additive also resulted in significantly lower wear than the commercial oil both with and without the ester additive when the ester was not added to the methanol.

Table II below presents a comparison of the wear in a slant 6 Dodge engine in 72 hours using the specially formulated oil (Oil A) and methanol with an ester additive with the wear resulting from use of a premium unleaded gasoline and previously described commercial lubricant (Oil B). The test conditions were similar to those set forth in Example 1.

TABLE II

| LUBRICANT | FUEL | Fe IN USED OIL, PPM 72 HOUR TEST |
|---|---|---|
| Oil A | Methanol + 90 ppm Ester(1) | 28 |
| Oil B | Gasoline | 18 |

Based upon the test data in Table II, it can be seen that the addition of the ester of a dimer acid of linoleic acid and diethylene glycol to the methanol fuel, when used in combination with a specially formulated lubricant, Oil A, reduced engine wear substantially to levels generally comparable to that obtained when commercially available lubricants and unleaded premium gasoline are used.

EXAMPLE 4

A four ball wear test was conducted to determine the approximate wear reduction achieved utilizing ethoxylated glycerol monococoate in methanol, as compared with methanol having no additive. A 30 kg. load was applied for 15 minutes at 1800 rpm at room temperature. The results are presented in Table III below.

TABLE III

| METHANOL ADDITIVE | Wear Volume, $mm^3$ |
|---|---|
| None | 0.077 |
| 0.1 vol % Ethoxylated | 0.0050 |

TABLE III-continued

| METHANOL ADDITIVE | Wear Volume, $mm^3$ |
|---|---|
| Glycerol Monococoate | |

The addition of ethoxylated glycerol monococoate resulted in a 94% decrease in wear volume.

What is claimed is:

1. A fuel composition having improved wear reduction and lubricity properties and comprising a major amount of monohydroxy alkanol having from 1 to 5 carbon atoms and an effective wear reducing amount of an additive which is an ester of a monocarboxylic or polycarboxylic acid and a polyhydric alcohol, said acid having about 2 to about 3 carboxylic acid groups and about 24 to about 65 carbon atoms, said alcohol having about 2 to about 10 hydroxyl groups and about 2 to about 90 carbon atoms and said ester having at least two free hydroxyl groups.

2. The fuel composition of claim 1 which contains from about 0.0003 to about 2.0 percent by weight of said ester additive.

3. The fuel composition of claim 2 which contains from about 0.001 to about 1.0 percent by weight of said ester additive.

4. The fuel composition of claim 2 wherein methanol is said alkanol.

5. The fuel composition of claim 4 wherein said additive is the reaction product of lanolin and a poly-hydric alcohol.

6. The fuel composition of claim 5 wherein said additive is polyoxyethylene sorbitol lanolin.

7. The fuel composition of claim 4 wherein said additive is a hydroxyl terminated ester of a polycarboxylic acid and a glycol or glycerol.

8. The fuel composition of claim 7 wherein said polyhydric alcohol is a glycol selected from the group consisting of alkane diols having from about 2 to about 12 carbon atoms or an oxa-alkane diol having from about 4 to about 200 carbon atoms.

9. The fuel composition of claim 8 wherein said polycarboxylic acid is a dicarboxylic acid having about 9 to about 42 carbon atoms between carboxylic acid groups.

10. The fuel composition of claim 9 wherein said dicarboxylic acid has from about 12 to about 42 carbon atoms between carboxylic acid groups.

11. The fuel composition of claim 27 wherein said polycarboxylic acid is a dimer of linoleic or oleic acid or mixtures thereof and said glycol is ethylene or diethylene glycol.

12. The fuel composition of claim 11 which contains from about 0.002 to about 0.5 percent by weight of said ester additive.

13. The fuel composition of claim 4 wherein the additive is an ester of a monocarboxylic acid and a polyhydric alcohol having at least three hydroxyl groups.

14. The fuel composition of claim 13 wherein the alcohol comprises a glycerol.

15. The fuel composition of claim 14 wherein the glycerol comprises an ethoxylated glycerol.

16. The fuel composition of claim 15 wherein the monocarboxylic acid comprises coconut acid.

17. A method of reducing wear in an engine operating on fuel containing a major amount of a monohydroxy alkanol having from 1 to 5 carbon atoms comprising adding an effective wear reducing amount of an additive which is an ester of a monocarboxylic or polycarboxylic acid and a polyhydric alcohol, said acid having about 2 to about 3 carboxylic acid groups and about 8 to about 65 carbon atoms, said alcohol having about 2 to about 10 hydroxyl groups and about 2 to about 90 carbon atoms and said ester having at least two free hydroxyl groups.

18. The method of claim 17 wherein methanol is said alkanol and from about 0.0003 to about 2.0 percent by weight of said ester additive is used.

19. The method of claim 18 wherein from about 0.001 to about 1.0 percent by weight of said ester additive is used.

20. The method of claim 19 wherein said additive is the reaction product of lanolin and a polyhydric alcohol.

21. The method of claim 19 wherein said additive is a hydroxyl terminated ester of a polycarboxylic acid and a glycol or glycerol.

22. The method of claim 21 wherein said polycarboxylic acid ester is formed from a dimer acid of a conjugated fatty acid having from about 16 to about 22 carbon atoms between carboxylic acid groups and a glycol.

23. The method of claim 19 wherein said additive is a hydroxyl terminated ester of a monocarboxylic acid and a glycerol.

24. The method of claim 23 wherein said additive is a hydroxyl terminated ester of a monocarboxylic acid and an ethoxylated glycerol.

25. A fuel composition having improved wear reduction and lubricity properties and comprising a major amount of a monohydroxy alkanol having from 1 to 5 carbon atoms and an effective wear reducing amount of an additive which is an ester of a monocarboxylic or polycarboxylic acid and a polyhydric alcohol, said acid is a dimer acid of a conjugated fatty acid wherein the carboxyl groups are separated from each other by about 16 to about 22 carbon atoms, said alcohol having about 2 to about 10 hydroxyl groups and about 2 to about 90 carbon atoms and said ester having at least two free hydroxyl groups.

* * * * *